US006980164B2

(12) United States Patent
Sampo et al.

(10) Patent No.: US 6,980,164 B2
(45) Date of Patent: Dec. 27, 2005

(54) AUTOMOBILE ANTENNA APPARATUS

(75) Inventors: Takeshi Sampo, Gunma (JP); Shigeo Suzuki, Gunma (JP); Takanori Tashiro, Gunma (JP)

(73) Assignee: Yokowo Co., Ltd., Tokyo (JP)

( * ) Notice: Subject to any disclaimer, the term of this patent is extended or adjusted under 35 U.S.C. 154(b) by 60 days.

(21) Appl. No.: 10/718,558

(22) Filed: Nov. 24, 2003

(65) Prior Publication Data

US 2004/0169608 A1 Sep. 2, 2004

(30) Foreign Application Priority Data

Nov. 25, 2002 (JP) ..... 2002-341359

(51) Int. Cl.[7] ..... H01Q 1/32
(52) U.S. Cl. ..... 343/713; 343/711
(58) Field of Search ..... 343/711, 713

(56) References Cited

U.S. PATENT DOCUMENTS

| | | | | |
|---|---|---|---|---|
| 4,760,402 | A * | 7/1988 | Mizuno et al. | 343/713 |
| 5,812,095 | A * | 9/1998 | Adrian et al. | 343/713 |
| 5,945,956 | A * | 8/1999 | Izawa et al. | 343/713 |
| 5,977,919 | A * | 11/1999 | Kudo et al. | 343/713 |
| 6,433,749 | B1 * | 8/2002 | Thompson | 343/713 |
| 6,644,700 | B2 * | 11/2003 | Ito et al. | 296/180.1 |
| 2003/0080908 | A1 * | 5/2003 | Mizutani | 343/713 |

* cited by examiner

*Primary Examiner*—Hoang V. Nguyen
*Assistant Examiner*—Marie Antoinette Cabucos
(74) *Attorney, Agent, or Firm*—Morgan, Lewis & Bockius LLP

(57) ABSTRACT

An antenna apparatus is mounted on a vehicle body provided with a spoiler made of an insulating resin. A feeder element is disposed in the spoiler such that the vehicle body serves as ground without providing a ground element in the spoiler.

2 Claims, 4 Drawing Sheets

AUTOMOBILE ANTENNA APPARATUS

BACKGROUND OF THE INVENTION

The present invention relates to automobile antenna apparatus used on a vehicle body provided with a spoiler.

In recent years, from the point of view of design, a spoiler having a wing-shaped cross section is often placed on a vehicle body in order to increase the tire contact pressure during high speed running to thereby permit stable driving. FIG. 5 is a view showing the state where a spoiler 12 is placed at a roof end of a vehicle body 10 of a station wagon type. Likewise in a minivan type or a truck type, a spoiler 12 is often placed at a roof end. On the other hand, FIG. 6 is a view showing the state where a spoiler 12 is placed on a trunk of a vehicle body 10 of a sedan type. Likewise in a coupe type, a spoiler 12 is often placed on a trunk.

These spoilers 12 are mainly molded from insulating resin in order to save the weight or for any other purpose. Of them, there are some spoilers 12 having antenna apparatus disposed therein. FIG. 7 is a view showing an example of the structure of related-art antenna apparatus disposed in a spoiler 12. As shown in FIG. 7, the related-art antenna apparatus is constituted by a feeder element 14 formed into an L-shaped (L-type feeder element) in a spoiler 12, and a ground element 16 formed into an L-shaped likewise. The feeder element 14 and the ground element 16 are disposed substantially symmetrically. A signal line is electrically connected to the feeder element 14 through a coaxial cable or the like, while the ground element 16 is electrically connected to a vehicle body 10 serving as the ground. When the antenna apparatus is placed in the spoiler 12, the antenna apparatus does not project from the vehicle body 10 so as to be excellent in terms of design.

In the related-art antenna apparatus shown in FIG. 7, the pattern of the directivity in a horizontal plane with respect to vertically polarized signals is necked and nowhere close to a circle as shown in FIG. 8. The antenna apparatus can be hardly regarded as nondirectional. Thus, there is a problem that the sensitivity to AM broadcasting signals and FM broadcasting signals transmitted as vertically polarized signals varies widely in accordance with the direction of the antenna apparatus, that is, the direction of the vehicle body 10.

In the related-art antenna apparatus, both the feeder element 14 and the ground element 16 are long in horizontal size but short in vertical size inevitably because they are disposed in the spoiler 12. It can be therefore considered that a signal current flowing vertically through the feeder element 14 and the ground element 16 is limited so that nondirectivity cannot be obtained in a horizontal plane with respect to vertically polarized signals.

SUMMARY OF THE INVENTION

It is therefore an object of the invention to provide automobile antenna apparatus disposed in a spoiler while nondirectivity can be obtained in a horizontal plane with respect to vertically polarized signals.

In order to achieve the above object, according to the invention, there is provided an antenna apparatus mounted on a vehicle body provided with a spoiler comprised of an insulating resin, comprising a feeder element, disposed in the spoiler such that the vehicle body serves as ground without providing a ground element in the spoiler.

In such a configuration, the antenna apparatus does not exposed from the vehicle body so as to be excellent in terms of design. In addition, since the vehicle body serves as the ground, most of a signal current can flow a long distance substantially vertically through the vehicle body so that substantial nondirectivity can be obtained in a horizontal plane with respect to vertically polarized signals. Thus, it is possible to prevent such a problem that the receiving sensitivity varies in accordance with the direction of the vehicle.

Preferably, the spoiler is disposed on a rear end portion of a roof of the vehicle body.

In such a configuration, the degree of capacitive coupling between the feeder element and the vehicle body is so small that high receiving sensitivity can be obtained in a required band. In addition, when the vehicle body is of a station wagon type, a minivan type or a truck type, a rear pillar is substantially vertical. Thus, most of a signal current can flow a long distance vertically through the vehicle body including the rear pillar so that the nondirectivity in a horizontal plane with respect to vertically polarized signals is more improved.

Alternatively, the spoiler may be disposed on a trunk of the vehicle body, such that a height of the spoiler from the trunk is at least 150 mm.

In such a configuration, the degree of capacitive coupling between the feeder element and the vehicle body can be reduced so that high receiving sensitivity can be obtained in a required band.

Preferably, the feeding element comprises a T-type element operable to receive both of an AM broadcasting signal and an FM broadcasting signal.

Alternatively, the feeding element may comprise at least one of an F-type element operable to receive an FM broadcasting signal and an L-type element operable to receive an AM broadcasting signal.

In such a configuration, high receiving sensitivity can be obtained for at least one of the AM and FM broadcasting signals.

BRIEF DESCRIPTION OF THE INVENTION

The above objects and advantages of the present invention will become more apparent by describing in detail preferred exemplary embodiments thereof with reference to the accompanying drawings, wherein.

DETAILED DESCRIPTION OF THE INVENTION

Preferred embodiments of the invention will be described below in detail with respect to the accompanying drawings.

Figure 1:
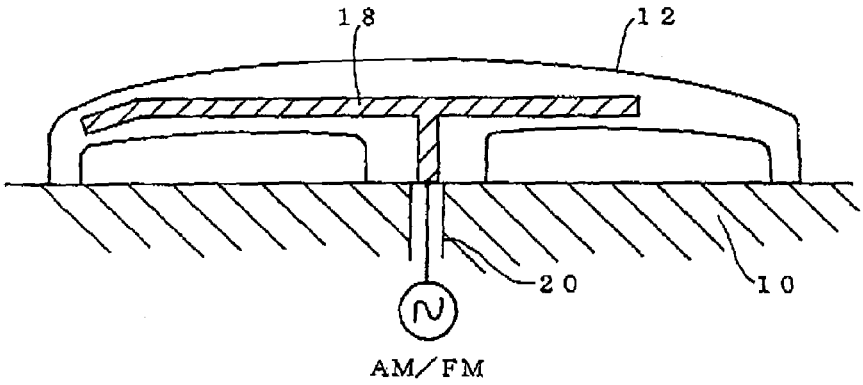
FIG. 1 is a view showing an automobile antenna apparatus according to a first embodiment of the invention.
Figure 5:
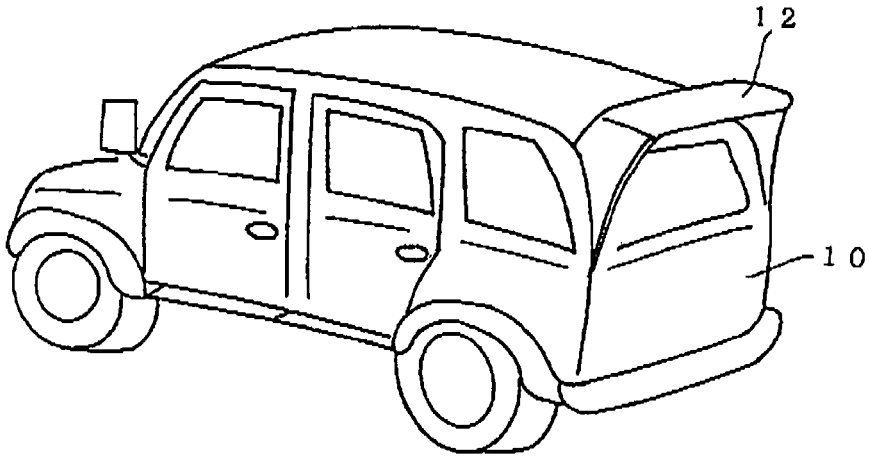
FIG. 5 is a view showing the state in which a spoiler is disposed at a roof end of a station wagon type vehicle body.
Figure 7:
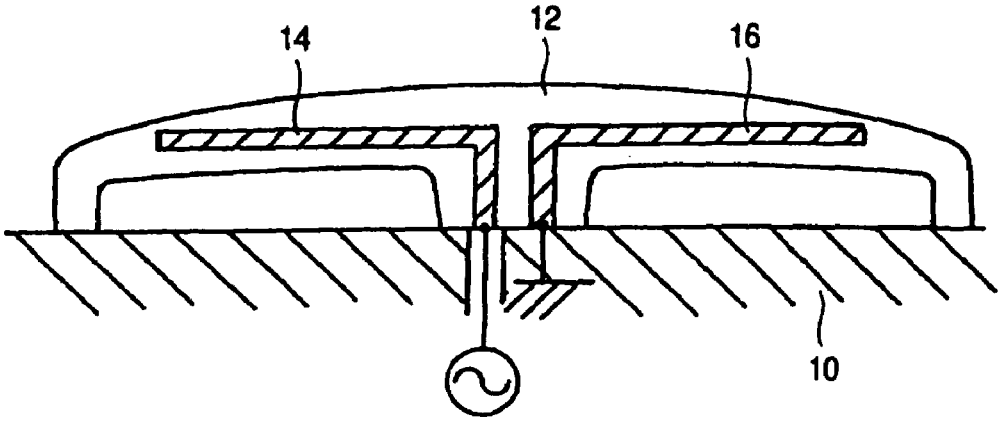
RELATED ART FIG. 7
FIG. 7 is a view showing a related-art antenna apparatus disposed in a spoiler.
Figure 8:
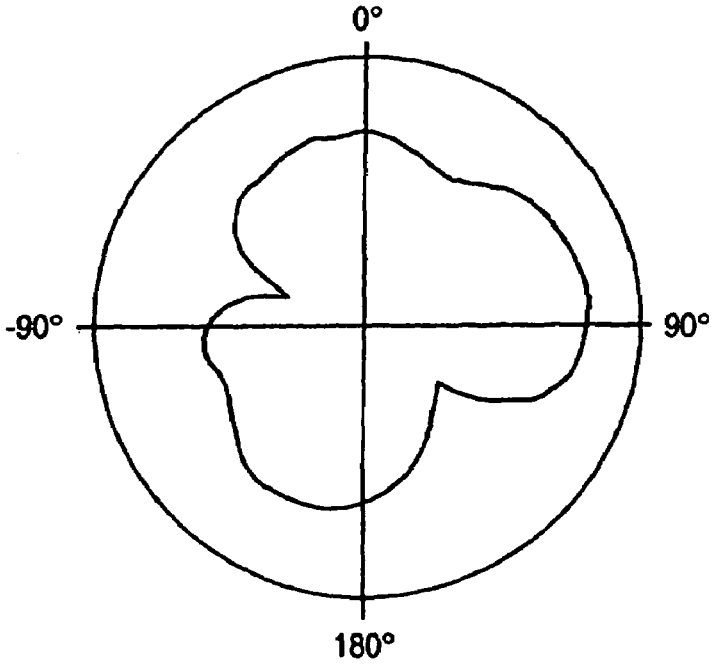
RELATED ART FIG. 8
FIG. 8 is a diagram showing the directivity of the antenna apparatus of FIG. 7, in a horizontal plane with respect to vertically polarized signals.

FIG. 1 shows an automobile antenna apparatus according to a first embodiment of the invention. In this embodiment, a T-type feeder element 18 is disposed in a spoiler 12 placed at a roof end of a vehicle body 10 of a station wagon type shown in FIG. 5. The T-type feeder element 18 is electrically connected to a receiver-side via a coaxial cable 20 and, if necessary, through a not-shown amplifier or a not-shown matching circuit. Unlike in the configuration shown in FIG. 7, a ground element 16 is not disposed in the spoiler 12.

Figure 2:
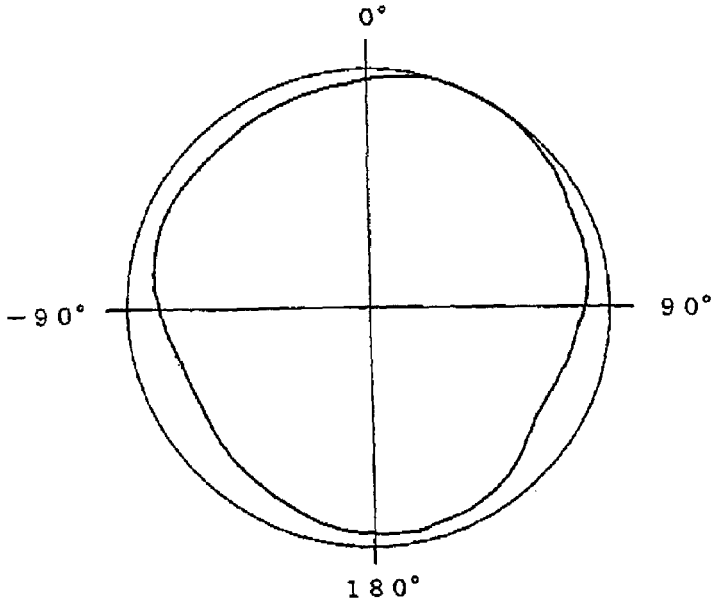
FIG. 2 is a diagram showing the directivity of the automobile antenna apparatus of FIG. 1, in a horizontal plane with respect to vertically polarized signals.

In the automobile antenna apparatus configured thus, the vehicle body 10 serves as the ground so that a signal current flows into the vehicle body 10 in accordance with a signal received by the feeder element 18. A substantially vertical pillar is provided in a rear end portion of the station-wagon type vehicle body 10. Accordingly, most of the signal current can flow a long distance vertically through the vehicle body 10 including the rear pillar. As a result, substantial nondirectivity can be obtained in a horizontal plane with respect to vertically polarized signals as shown in FIG. 2. In addition, in the T-type feeder element 18, sufficient receiving sensitivity can be obtained for both AM broadcasting signals and FM broadcasting signals.

Figure 3:
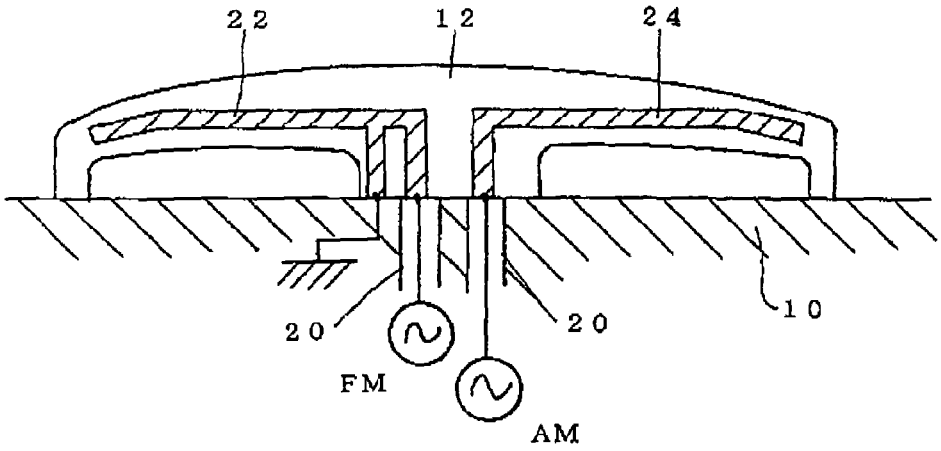
FIG. 3 is a view showing an automobile antenna apparatus according to a second embodiment of the invention.

FIG. 3 shows an automobile antenna apparatus according a second embodiment of the invention. In this embodiment, two feeder elements, namely, an F-type feeder element 22 and an L-type feeder element 24 are disposed in a spoiler 12 substantially symmetrically. The F-type and L-type feeder elements 22 and 24 are properly electrically connected via coaxial cables 20, respectively.

From each of the F-type and L-type feeder elements 22 and 24, most of a signal current flows a long distance through the vehicle body 10 including the rear pillar and serving as the ground. Accordingly, substantial nondirectivity could be obtained in a horizontal plane with respect to vertically polarized signals in the same manner as in the automobile antenna apparatus in FIG. 1. However, as for the F-type feeder element 22, good receiving sensitivity to FM broadcasting signals can be indeed obtained, but receiving sensitivity to AM broadcasting signals is not good. On the other hand, as for the L-type feeder element 24, good receiving sensitivity to AM broadcasting signals can be indeed obtained, but receiving sensitivity to FM broadcasting signals is not good. Therefore, in order to receive both AM broadcasting signals and FM broadcasting signals, both the F-type and L-type feeder elements 22 and 24 are required. Not to say, when only AM broadcasting signals or FM broadcasting signals are to be received, a suitable one of the feeder elements may be disposed in the spoiler 12.

A similar result can be obtained in automobile antenna apparatus when the spoiler 12 is disposed at the roof end of a vehicle body 10 of a minivan type or a truck type.

Figure 6:
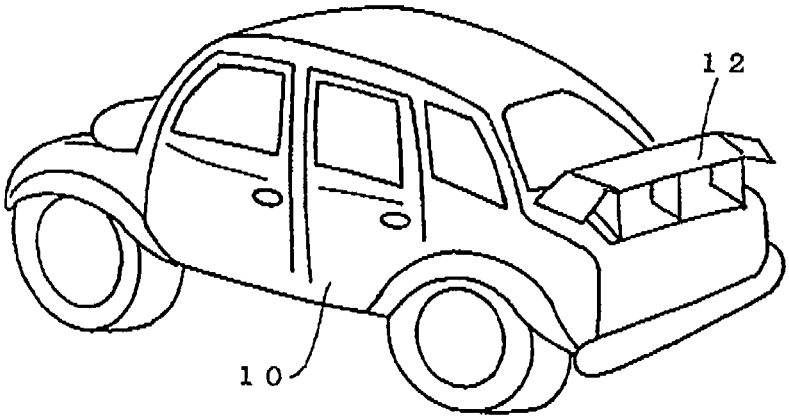
FIG. 6 is a view showing the state in which a spoiler is disposed on a trunk of a sedan type vehicle body.

However, a satisfactory result can not be obtained in automobile antenna apparatus when the spoiler 12 is disposed on a trunk of a vehicle body 10 of a sedan type or a coupe type shown in FIG. 6. Particularly, the receiving sensitivity was not satisfactory. The difference in structure between a roof end of a station wagon type and a trunk of a sedan type is whether a rear window is close to the spoiler 12 or not. It is considered that the degree of capacitive coupling occurring between the feeder element 18, 22, 24 disposed in the spoiler 12 and the vehicle body 10 may not be so large when the rear window was close to the spoiler 12, but the degree of capacitive coupling occurring between the feeder element 18, 22, 24 disposed in the spoiler 12 and the vehicle body 10 may be large when the rear window was not close to the spoiler 12.

Figure 4:
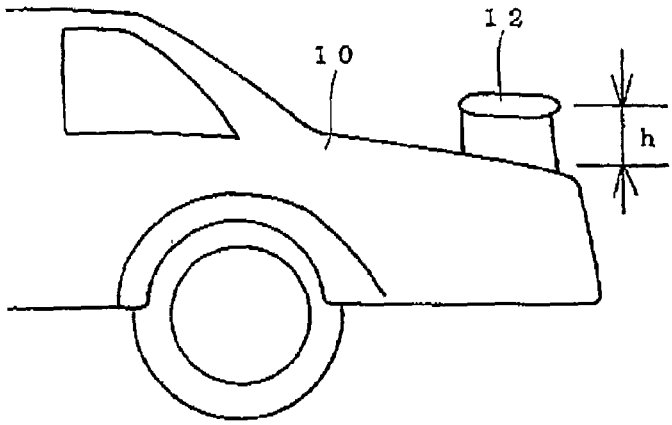
FIG. 4 is an explanatory view of a height of a spoiler from a trunk of a sedan type vehicle body.

As a result of an experiment that a height h (see FIG. 4) of the spoiler 12 from the trunk of the vehicle body 10 is varied, it is confirmed that practically sufficient receiving sensitivity can be obtained when the height h is at least 150 mm. Further, in a case where the spoiler 12 is disposed at the roof end of the sedan type vehicle body 10, receiving sensitivity similar to that in the case where the spoiler 12 is disposed on a vehicle 10 of a station wagon type can be obtained. In view of the above, it is confirmed that the directivity and the receiving sensitivity are not so affected by the difference in type of vehicle, but the degree of capacitive coupling between the vehicle body 10 and the feeder element 18, 22, 24 has a large influence on the receiving sensitivity in a required band.

The dimensions of the feeder element 18, 22 may be set suitably to be able to resonate with FM broadcasting signals. A matching circuit or an amplifier circuit may be provided suitably in accordance with necessity when the receiving sensitivity is measured.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An antenna apparatus mounted on a vehicle body provided with a spoiler comprised of an insulating resin, the antenna apparatus comprising a feeder element, disposed in the spoiler such that the vehicle body serves as ground without providing a ground element in the spoiler, wherein the feeding element comprises a T-type element operable to receive both an AM broadcasting signal and an FM broadcasting signal.

2. An antenna apparatus mounted on a vehicle body provided with a spoiler comprised of an insulating resin, the antenna apparatus comprising a feeder element, disposed in the spoiler such that the vehicle body serves as ground without providing a ground element in the spoiler, wherein the feeding element comprises at least one of an F-type element operable to receive an FM broadcasting signal and an L-type element operable to receive an AM broadcasting signal.

* * * * *